United States Patent [19]

Davis et al.

[11] 3,946,100

[45] Mar. 23, 1976

[54] PROCESS FOR THE EXPEDITIOUS FORMATION AND STRUCTURAL MODIFICATION OF POLYESTER FIBERS

[75] Inventors: Herbert L. Davis, Convent Station; Michael L. Jaffee, North Plainfield; Michael M. Besso, West Orange, all of N.J.

[73] Assignee: Celanese Corporation, New York, N.Y.

[22] Filed: Sept. 26, 1973

[21] Appl. No.: 400,863

[52] U.S. Cl. ..... 264/210 F; 264/176 F; 264/234; 264/290 T

[51] Int. Cl.[2] ..... D01D 5/12

[58] Field of Search ..... 164/176 F, 210 F, 290 T, 164/168, 234

[56] References Cited

UNITED STATES PATENTS

| | | | |
|---|---|---|---|
| 2,957,747 | 10/1960 | Bowling | 264/168 |
| 3,229,330 | 1/1966 | Ferreev et al. | 264/210 F |
| 3,513,110 | 5/1970 | Noether | 264/210 F |
| 3,550,369 | 12/1970 | Pitzl | 264/210 F |
| 3,706,826 | 12/1972 | Bremner et al. | 264/176 F |
| 3,752,457 | 8/1973 | Parmeggiani et al. | 264/176 F |
| 3,798,298 | 3/1974 | Krompen et al. | 264/210 F |

FOREIGN PATENTS OR APPLICATIONS

| | | | |
|---|---|---|---|
| 43-11825 | 5/1968 | Japan | 264/210 F |
| 44-7383 | 4/1969 | Japan | 264/176 F |
| 45-1932 | 1/1970 | Japan | 264/210 F |
| 45-15803 | 6/1970 | Japan | 264/168 |

*Primary Examiner*—Jay H. Woo

*Attorney, Agent, or Firm*—Thomas J. Morgan; Charles B. Barris

[57] ABSTRACT

An improved process is provided for the production of polymeric filamentary material or film. Molten melt-spinnable polymeric material capable of undergoing crystallization (e.g., a polyester) is extruded through a shaped orifice to form a filamentary material or film under high stress conditions, quenched to below its glass transition temperature to form a solid filamentary material or film, and sequentially passed for a brief residence time through a thermal conditioning zone at a temperature between its glass transition temperature and its melting temperature wherein the internal structure thereof is modified and substantial crystallization of the previously solidified filamentary material or film takes place. The filamentary material or film is withdrawn from the conditioning zone at a rate of 1000 to 6000 meters per minute while under a relatively high stress of about 0.1 to 1.0 gram per denier. The process is conducted while exerting a constant tension upon the filamentary material or film in the absence of stress isolation. The melt extrusion process yields a product wherein the tensile strength and modulus are improved and the shrinkage characteristics are diminished.

32 Claims, 1 Drawing Figure

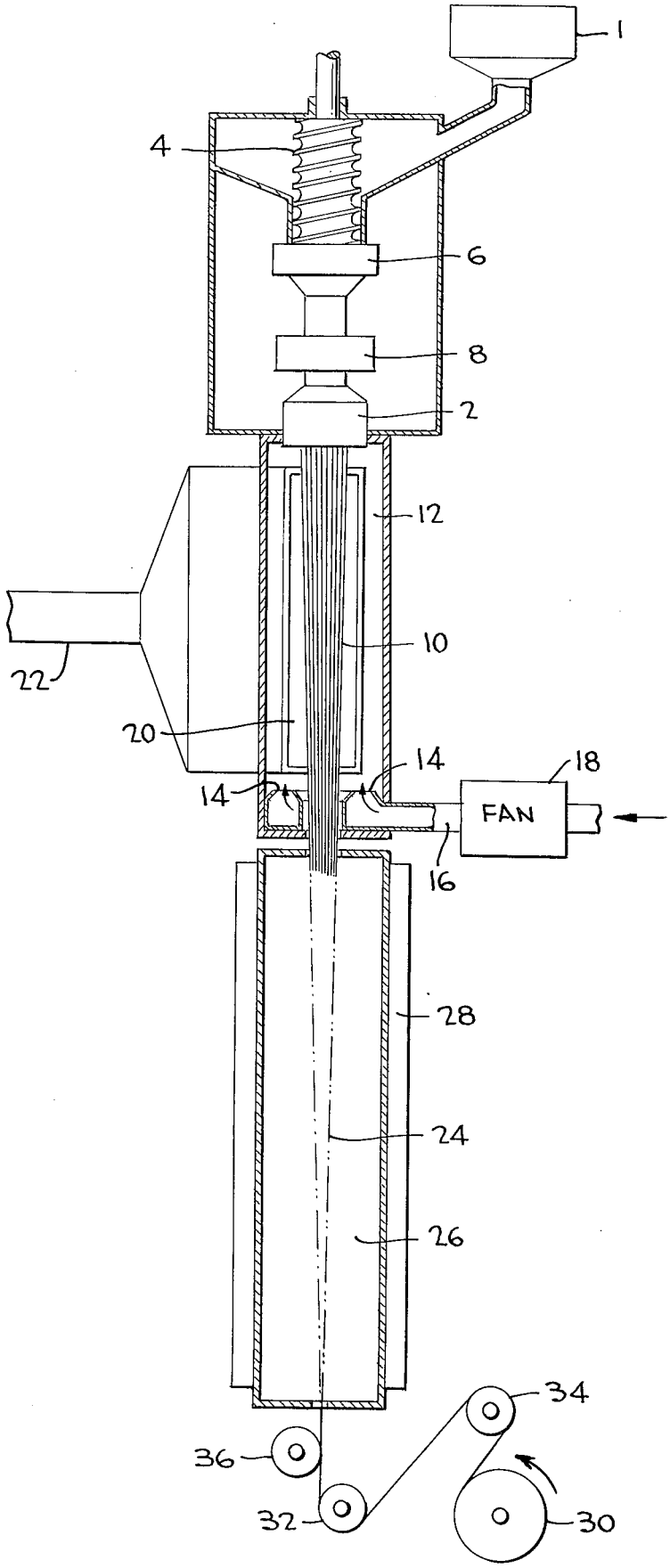
1
4
6
8
2
12
10
22
20
14
14
18
FAN
16
28
24
26
34
36
32
30

PROCESS FOR THE EXPEDITIOUS FORMATION AND STRUCTURAL MODIFICATION OF POLYESTER FIBERS

BACKGROUND OF THE INVENTION

Polymeric filamentary materials and films have been produced in the past under a variety of melt extrusion conditions. Both high stress and low stress spinning processes have been employed. Under high stress conditions the as-spun filamentary material is withdrawn from the spinneret under conditions whereby substantial orientation is imparted to the same soon after it is extruded and prior to its complete solidification. See, for instance, U.S. Pat. Nos. 2,604,667 and 2.604,689. Such high stress conditions of the prior art commonly yield a non-uniform filamentary material wherein substantial radial non-homogeneity exists across the fiber diameter leading to self-crimping characteristics upon heating, or less than desired tensile properties.

Melt spinning processes have also been proposed wherein the cooling of the extruded filamentary material has been retarded (i.e., prolonged) prior to complete solidification so as to alter the properties thereof. See, for instance, U.S. Pat. Nos. 2,323,383; 3,053,611 and 3,361,859.

Heretofore, polymeric fibers, e.g., polyester fibers, following extrusion and solidification have commonly been drawn while at an elevated temperature to further enhance their tensile properties. Such drawing may be conducted in an in-line fashion following fiber formation wherein the fiber is passed about appropriate drawing equipment of after the as-spun fiber is unwound from an intermediate collection device. Such drawing is commonly conducted upon contact with an appropriate heating device, heated gaseous atmosphere, or heated liquid medium. Also, it has been known that previously drawn polyester fibers may be heat treated with or without allowed shrinkage (i.e., post-annealed) in order to modify their physical properties.

As-spun polyester filamentary material consisting principally of polyethylene terephthalate, because of its extremely slow crystallization rate at room temperature, forms a stable fiber package unlike an as-spun polyamide filamentary material. As-spun polyamide filamentary materials have a marked tendency to rapidly crystallize at room temperature with an accompanying growth in fiber length thereby rendering wound fiber packages of the same highly unstable and difficult to handle. See, for instance, U.S. Pat. No. 3,291,880 which discloses a process for treating an as-spun polyamide yarn with steam so as to render it capable of forming a stable fiber package. A comparable treatment of an as-spun polyester filamentary material has been completely omitted, since the need for such intermediate processing is absent. Also, a polyamide filamentary material commonly is taken up following melt extrusion and solidification at a lower stress for a given take-up speed than a polyester filamentary material formed using the same equipment because of the varying extensional viscosities of the polymeric materials.

It is an object of the present invention to provide an improved process for the formation and structural modification of a polymeric filamentary material and film.

It is an object of the present invention to provide a process for the production of filamentary material or film possessing commercial properties directly from the spinning machine.

It is an object of the present invention to provide an improved process for the production of a polymeric filamentary material or film which operates at high speed.

It is another object of the present invention to provide an overall process for the production of polyester filamentary material possessing commercial properties which may be carried out on a highly economical basis.

It is another object of the present invention to provide a process for the formation of a novel polyester fiber which may be carried out employing conventional nylon fiber equipment provided with an appropriate conditioning zone and take-up equipment to produce the desired stress.

It is a further object of the present invention to provide an improved process for the production of polyester fiber wherein a conventional drawing process for the solidified fiber may be completely eliminated.

These and other objects, as well as the scope, nature and utilization of the process, will be apparent to those skilled in the art from the following description and appended claims.

SUMMARY OF THE INVENTION

It has been found that an improved process for expeditiously forming and structurally modifying a polymeric filamentary material or film comprises:

a. extruding a molten melt-spinnable polymeric material capable of undergoing crystallization through a shaped orifice to form a molten filamentary material or film, b. passing the resulting molten filamentary material or film in the direction of its length through a solidification zone provided with a gaseous atmosphere at a temperature below the glass transition temperature thereof wherein the molten filamentary material or film is transformed to a solid filamentary or film, c. passing the resulting filamentary material or film in the direction of its length through a conditioning zone provided with a gaseous atmosphere at a temperature above the glass transition temperature thereof and below the melting temperature thereof for a residence time of about 0.0001 to 0.8 second, wherein substantial crystallization of said previously solidified filamentary material or film takes place, and d. withdrawing the resulting filamentary material or film from the conditioning zone at a rate of 1000 to 6000 meters per minute while under a stress of about 0.1 to 1.0 gram per denier;

with the processing of the polymeric filamentary material or film following the extrusion being conducted while exerting a constant tension thereon in the absence of stress isolation along the length of the same intermediate the shaped orifice and the point of withdrawal from said conditioning zone (i.e., the filamentary material or film is axially suspended in the absence of external stress isolation devices in the region intermediate the shaped orifice and the point of withdrawal from the conditioning zone).

DESCRIPTION OF THE DRAWING

The drawing is a schematic presentation of an apparatus arrangement capable of carrying out the improved process of the present invention.

DESCRIPTION OF PREFERRED EMBODIMENTS

Those polymeric materials which are melt-spinnable and capable of undergoing crystallization, i.e., when heated between their glass transition temperature and their melting temperature, may be selected for use in the present process.

The preferred polymeric materials for use in the present process are melt-spinnable polyesters. For instance, the melt-spinnable polyester selected for use in the present process may be principally polyethylene terephthalate, and contain at least 85 mol percent polyethylene terephthalate, and preferably at least 90 mol percent polyethylene terephthalate. In a particularly preferred embodiment of the process the melt-spinnable polyester is substantially all polyethylene terephthalate. Alternatively, during the preparation of the polyester minor amounts of one or more ester-forming ingredients other than ethylene glycol and terephthalic acid or its derivatives may be copolymerized. For instance, the melt-spinnable polyester may contain 85 to 100 mol percent (preferably 90 to 100 mol percent) polyethylene terephthalate structural units and 0 to 15 mol percent (preferably 0 to 10 mol percent) copolymerized ester units other than polyethylene terephthalate. Illustrative examples of other ester-forming ingredients which may be copolymerized with the polyethylene terephthalate units include glycols such as diethylene glycol, tetramethylene glycol, hexamethylene glycol, etc., and dicarboxylic acids such as hexahydroterephthalic acid, bibenzoic acid, adipic acid, sebacic acid, azelaic acid, etc.

The melt-spinnable polyethylene terephthalate selected for use in the process preferably exhibits an intrinsic viscosity, i.e., I.V., of about 0.45 to 1.0, and an I.V. of about 0.6 to 0.95 in a particularly preferred embodiment of the process. The I.V. of the melt-spinnable polyester may be conveniently determined by the equation $$\lim_{c \to o} \frac{\ln \eta r}{c},$$

where $\eta$ r is the "relative viscosity" obtained by dividing the viscosity of a dilute solution of the polymer by the viscosity of the solvent employed (measured at the same temperature), and $c$ is the polymer concentration in the solution expressed in grams/100 ml. The polyethylene terephthalate additionally commonly exhibits a glass transition temperature of about 75° to 80°C. and a melting point of about 250° to 265°C., e.g., about 260°C.

The extrusion orifice may be selected from among those commonly utilized during the melt extrusion of fibers or films. For instance, the shaped extrusion orifice may be in the form of a rectangular slit when forming a polymeric film. When forming a filamentary material the spinneret selected for use in the process may contain one or preferably a plurality of extrusion orifices. For instance, a standard conical spinneret containing 1 to 200 holes (e.g., 6 to 200 holes), such as commonly used in the melt spinning of polyethylene terephthalate, having a diameter of about 10 to 60 mils (e.g., 10 to 40 mils) may be utilized in the process. Yarns of about 20 to 36 continuous filaments are commonly formed. The melt-spinnable polymeric material is supplied to the extrusion orifice at a temperature above its melting point.

A molten polyester consisting principally of polyethylene terephthalate is preferably at a temperature of about 270° to 310°C., and most preferably at a temperature of about 285° to 305°C. (e.g., 300°C.) when extruded through the spinneret.

Subsequent to extrusion through the shaped orifice the resulting molten filamentary material or film is passed in the direction of its length through a solidification zone provided with a gaseous atmosphere at a temperature below the glass transition temperature thereof wherein the molten filamentary material or film is transformed to a solid filamentary material or film. When the filamentary material or film is principally polyethylene terephthalate the gaseous atmosphere of the solidification zone is provided at a temperature below about 80°C. Within the solidification zone the molten material passes from the melt to a semi-solid consistency, and from the semi-solid consistency to a solid consistency. While present in the solidification zone the material undergoes substantial orientation while present as a semi-solid as discussed hereafter. The solidification zone could also be termed a "quench zone". The gaseous atmosphere present within the solidification zone preferably circulates so as to bring about more efficient heat transfer. In a preferred embodiment of the process the gaseous atmosphere of the solidification zone is provided at a temperature of about 10° to 40°C., and most preferably at about room temperature (e.g., at about 25°C.). The chemical composition of the gaseous atmosphere is not critical to the operation of the process provided the gaseous atmosphere is not unduly reactive with the polymeric filamentary material or film. In a particularly preferred embodiment of the process the gaseous atmosphere of the solidification zone is air. Other representative gaseous atmospheres which may be selected for utilization in the solidification zone include inert gases such as helium, argon, nitrogen, etc.

The gaseous atmosphere of the solidification zone preferably impinges upon the extruded polymeric material so as to produce a uniform quench wherein no substantial radial non-homogeneity exists across the product. The uniformity of the quench may be demonstrated with a filamentary material through its ability to exhibit no substantial tendency to undergo self-crimping upon the application of heat. A flat yarn accordingly is produced in a preferred embodiment of the process.

The solidification zone is preferably disposed immediately below the shaped extrusion orifice and the extruded polymeric material is present while axially suspended therein for a residence time of about 0.0008 to 0.4 second, and most preferably for a residence time of about 0.033 to 0.14 second. Commonly the solidification zone possesses a length of about 0.25 to 20 feet, and preferably a length of 1 to 7 feet. The gaseous atmosphere is also preferably introduced at the lower end of the solidification zone and withdrawn along the side thereof with the moving continuous length of polymeric material passing downwardly therethrough from the spinneret. A center flow quench or any other technique capable of bringing about the desired quenching alternatively may be utilized. If desired, a hot shroud may be positioned intermediate the shaped orifice and the solidification zone.

The resulting filamentary material or film is next passed in the direction of its length through a conditioning zone provided with a gaseous atmosphere at a temperature above the glass transition temperature thereof and below the melting temperature thereof for a residence time of about 0.0001 to 0.8 second, wherein substantial crystallization of the previously solidified filamentary material or film takes place. In a preferred embodiment wherein the filamentary material or film is principally polyethylene terephthalate the conditioning zone is provided with a gaseous atmosphere at a temperature of about 90° to 180°C. (e.g., 90° to 140°C.) and the previously solidified material is present therein for a residence time of about 0.001 to 0.8 second. In a particularly preferred embodiment the conditioning zone is provided with a gaseous atmosphere at a temperature of about 100 to 120°C. The preferred residence time for the filamentary material or film which is principally polyethylene terephthalate within the conditioning zone is about 0.0016 to 0.6 second, and most preferably about 0.03 to 0.09 second. If residence times much below about 0.0001 second are employed, then a stable achievement of the desired property levels commonly does not result. The optimum residence time required to produce substantial crystallization may vary with the polymeric material involved. Longer residence times may be utilized with no commensurate advantage.

The chemical composition of the gaseous atmosphere provided within the conditioning zone is not critical to the operation of the process provided the gaseous atmosphere is not unduly reactive with the polymeric filamentary material or film. Static air or steam conveniently may be selected. Other representative gaseous atmospheres which may be employed in the conditioning zone include helium, argon, nitrogen, etc. Band heaters or any other heating means may be provided so as to maintain the conditioning zone at the required temperature. The conditioning zone commonly has a length of about 0.5 to 30 feet, and preferably a length of about 5 to 12 feet.

The resulting filamentary material or film is withdrawn from the conditioning zone at a rate of about 1000 to 6000 meters per minute (preferably 2500 to 3500 meters per minute) while under a stress of about 0.1 to 1 gram per denier (preferably 0.15 to 0.6 gram per denier and most preferably 0.2 to 0.4 gram per denier). Following extrusion the filamentary material or film is maintained under constant tension and throughout the process no stress isolation is utilized along the length of the filamentary material or film intermediate the shaped orifice (e.g., spinneret) and the point of withdrawal from the conditioning zone (e.g., a yarn is axially suspended in the absence of external contact in the region intermediate the spinneret and the point of withdrawal from the conditioning zone). When withdrawn from the conditioning zone the filamentary material commonly exhibits a denier per filament of about 1 to 15, e.g., about 1.5 to 5.

The improved melt extrusion process of the present invention may be conveniently carried out in conventional nylon equipment provided with a heated conditioning chamber of adequate length below the quench zone and having the required high stress take-up equipment. The results achieved with a melt-spinnable polymeric material described herein are considered to be unexpected to those skilled in melt spinning technology.

While present in the conditioning zone, the filamentary material or film is heat treated under constant tension. During this heat treatment, small amounts of thermally induced elongation may occur, but this process is differentiated from a draw process because of the constant tension rather than the constant strain criteria. The level of tension on the filamentary material or film in the conditioning zone is extremely critical to the development of the desired structure and properties and primarily is influenced by the rate of withdrawal from the conditioning zone rather than friction with the surrounding gaseous atmosphere. No stress isolation results along the filamentary material or film intermediate the shaped orifice and the point of withdrawal from the conditioning zone (e.g., the filamentary material is axially suspended in the absence of external stress isolating devices in the region intermediate the spinneret and the point of withdrawal from the conditioning zone). Should one omit the passage of the filamentary material through the conditioning zone, the denier and cross sectional dimension of the filamentary material commonly are found to identical.

In the high stress melt spinning process of the present invention the extruded filamentary material or film intermediate the point of its maximum die swell area and its point of withdrawal from the conditioning zone commonly exhibits a substantial drawdown. For instance, a filamentary material may exhibit a drawdown ratio of about 100:1 to 2000:1, and most commonly a drawdown ratio of about 600:1 to 1700:1. The "drawdown ratio" as used above is defined as the ratio of the maximum die swell cross sectional area to the cross sectional are of the filamentary material as it leaves the conditioning zone. Such substantial change in cross sectional area occurs almost exclusively in the solidification zone prior to complete quenching. In some embodiments of the process, however, up to about a 4:1 reduction in cross sectional area of the filamentary material is observed in the conditioning zone via heat induced elongation as discussed above.

The passage of the filamentary material or film through the conditioning zone in the precise manner described surprisingly has been found to beneficially enhance the same through the modification of its internal structural morphology. More specifically, the tensile properties are surprisingly improved and may render a conventional hot drawing step unnecessary. The tensile strength and modulus are improved and the shrinkage characteristics are diminished.

A resulting polyester filament is claimed in our commonly assigned U.S. Ser. No. 400,864, entitled "Improved Polyester Fiber" filed concurrently herewith, and differs structurally from polyester fibers heretofore produced in that it has an interconnected highly oriented crystalline microstructure coextensive with its length coexisting with an interdispersed substantially disoriented non-crystalline phase, and exhibits a propensity to undergo a low degree of shrinkage with a high degree of force at an elevated temperature as evidenced by a modulus ratio of at least 0.1. Also the filamentary material exhibits a relatively high initial modulus, coupled with a relatively high crystalline orientation function, and a relatively low amorphous orientation function, i.e., a mean initial modulus when present in a multifilament yarn at 25°C. of at least 55 grams per denier, a birefringence of about 0.10 to 0.14, a crystalline orientation function of at least 0.88, and an amorphous orientation function of not more than 0.35. See our concurrently filed application for an amplified discussion of the resulting polyester filament.

For instance, the polyester filaments of the present invention commonly exhibit when present in a multifilament yarn at room temperature, i.e. 25°C., the means tensile properties indicated below:

| | Preferred Embodiment | Particularly Preferred Embodiment |
|---|---|---|
| Tenacity | at least 3.25 grams per denier | at least 3.75 grams per denier |
| Initial Modulus | at least 55 grams per denier | at least 75 grams per denier |
| Elongation | less than 75 percent | less than 50 percent |

The tensile properties may be determined through the utilization of an Instron tensile tester (Model TM) using a 3⅓ inch gauge length and a strain rate of 60 percent per minute in accordance with ASTM D2256. The yarn prior to testing is conditioned for 48 hours at 70°F. and 65 percent relative humidity in accordance with ASTM D1776. It will be noted that the tenacity and initial modulus values are comparable to those encountered in commercial polyester filaments of the prior art.

The polyester filaments of the present invention exhibit highly desirable thermomechanical properties at elevated temperatures which result in improved dimensional stability. When present in a multifilament yarn in air, the filaments shrink less than 5 percent at 100°C. (preferably less than 3 percent), and less than 8 percent at 175°C. (preferably less than 7.6 percent). The above shrinkage values may be determined through the utilization of a DuPont Thermomechanical Analyzer (Model 941) operated under zero applied load and at 10°C./min. heating rate with the gauge length held constant at 0.5 inch.

The theory whereby the present process is capable of producing a polymeric filamentary material or film exhibiting the properties recited is considered complex and incapable of simple explanation. It is believed, however, that the stress exerted upon the semi-solid filamentary material or film in the solidification zone produces an oriented crystalline fibrillar microstructure of polymer molecules within the same which serves to nucleate the epitaxial growth of polymer crystals intermediate adjoining fibrils. As the resulting filamentary material or film next passes through the conditioning zone, as defined, substantial epitaxial crystallization spontaneously occurs onto the oriented fibrillar structure. Such rapid crystallization is believed to form a lamella overgrowth on the existing fibrillar structure with lamellar crystals extending between fibrils and with the lamellar crystals being joined by tie molecules.

The resulting filamentary material or film is amenable to further processing through the use of additional processing equipment or it may be used directly in applications requiring a continuous filament commercial yarn. If desired, the filamentary material subsequently may be converted from a flat yarn to a textured yarn, e.g., through the utilization of known false twist texturing conditions. Illustrative conditions for a yarn of 150 denier employ a yarn speed of 125 meters per minute, a feed roll heater plate temperature of 215°C., an over feed into the heater of about 3.5 percent, and a turn per inch of about 60.

The following examples are given as specific illustrations of the process. It should be understood, however, that the invention is not limited to the specific details set forth in the examples. Reference is made in the examples to the apparatus arrangement illustrated in the drawing. The claimed invention is not restricted to the utilization of the apparatus illustrated in the drawing.

EXAMPLE I

Polyethylene terephthalate having an intrinsic viscosity (I.V.) of 0.67 was selected as the starting material. The intrinsic viscosity was determined from a solution of 0.1 gram of the polymer in 100 ml. of ortho-chlorophenol at 25°C.

The polyethylene terephthalate polymer while in particulate form was placed in hopper 1 and was advanced toward spinneret 2 by the aid of screw conveyer 4. Heater 6 caused the polyethylene terephthalate particles to melt to form a homogeneous phase which was further advanced toward spinneret 2 by the aid of pump 8.

The spinneret 2 had a standard conical entrance and possessed a ring of 20 extrusion holes, each having a diameter of 20 mils. The molten polyethylene terephthalate was at a temperature of about 300°C. when extruded through spinneret 2.

The resulting extruded polyethylene terephthalate 10 passed directly from the spinneret 2 through solidification zone 12. The solidification zone 12 had a length of 6 feet and was vertically disposed. Air at room temperature (i.e., about 25°C.) was continuously introduced into solidification zone 12 at 14 which was supplied via conduit 16 and fan 18. The air was continuously withdrawn through elongated conduit 20 vertically disposed in communication with the wall of solidification zone 12, and was continuously withdrawn through conduit 22. While passing through the solidification zone the extruded polyethylene terephthalate was uniformly quenched and was transformed into a continuous length of as-spun polyethylene terephthalate yarn. The polymeric material was first transformed from a molten to a semi-solid consistency, and then from a semi-solid consistency to a solid consistency while passing through solidification zone 12. The extruded polyethylene terephthalate was present in the solidification zone 12 for a residence time of about 0.045 second.

Upon being withdrawn from solidification zone 12 the continuous length of polyethylene terephthalate yarn 24 next immediately was passed through vertically disposed conditioning zone 26 having a length of 12 feet. A static air atmosphere was maintained in conditioning zone 26 at a temperature of 120°C. by the aid of band heater 28 which surrounded the walls of the same. The polyethylene terephthalate yarn was present in the conditioning zone 26 for a residence time of about 0.09 second where it was structurally modified.

The resulting polyethylene terephthalate yarn was under a constant tension following extrusion and was withdrawn from conditioning zone 26 at a rate of 2500 meters per minute while under a stress of about 0.2 gram per denier. The extruded filamentary material intermediate the point of its maximum die swell area and its point of withdrawal from the conditioning zone was drawn down at a ratio of about 1400:1. The resulting polyethylene terephthalate yarn exhibited a denier per filament of 2, and was packaged at 30 after passing around godets 32 and 34, and contacting roller 36 which applied an anti-static lubricant.

The polyethylene terephthalate yarn was axially suspended in the absence of external contact intermediate the spinneret and the point of its withdrawal from conditioning zone 26. There was accordingly no stress isolation along the length of the same in this region and the fibrous material was under substantial stress through its processing which was exerted by rotation of packaging equipment 30.

For comparative purposes, Example I was repeated with the exception that the static air atmosphere of the conditioning zone 26 was provided at room temperature (i.e., about 25°C.) instead of 120°C. The extruded filamentary material intermediate the point of its maximum die swell area and its point of withdrawal from the conditioning zone was drawn down at a ratio of about 1400:1. The resulting yarn upon withdrawal from the conditioning zone 26 exhibited a denier per filament of 2.

Summarized below are the properties of the resulting polyethylene terephthalate product. See our commonly assigned U.S. Ser. No. 400,864, entitled "Improved Polyester Fiber" filed concurrently herewith, for a more detailed discussion of how the reported properties were determined.

| | With Invention (Conditioning Tube at 120°C.) | Without Invention (Conditioning Tube at 25°C.) |
|---|---|---|
| Denier Per Filament | 2 | 2 |
| Mean Yarn Tenacity (grams per denier) | 3.7 | 1.92 |
| Mean Yarn Elongation (percent) | 56 | 175 |
| Mean Yarn Initial Modulus (grams per denier) | 70 | 22.5 |
| Mean Yarn Shrinkage at 100°C. (percent) | 3.7 | 33.0 |
| Mean Yarn Shrinkage at 175°C. (percent) | 6.6 | 16.5 |
| Mean Yarn Internal Tension at 100°C. (grams/denier) | 0.36 | 0.026 |
| Mean Yarn Internal Tension at 175°C. (grams/denier) | 0.25 | 0.005 |
| Maximum, Yarn Internal Tension (grams/denier) | 0.37 | 0.039 |
| Shrinkage Modulus at 100°C. (grams/denier) | 10.0 | 0.079 |
| Shrinkage Modulus at 175°C. (grams/denier) | 3.79 | 0.030 |
| Modulus Ratio | 0.143 | 0.0036 |
| Birefringence | 0.1188 | 0.025 |
| Crystalline Orientation Function | 0.92 | * |
| Amorphous Orientation Function | 0.30 | 0.10 |

* = Not crystalline enough to yield useful diffraction

EXAMPLE II

Example I was repeated with the exception that the resulting polyethylene terephthalate yarn was withdrawn from conditioning zone 26 at a rate of 3000 meters per minute while under a stress of about 0.25 gram per denier. The extruded polyethylene terephthalate yarn was present in the solidification zone 12 for a residence time of about 0.036 second. The polyethylene terephthalate yarn was present in the conditioning zone 26 for a residence time of about 0.07 second. The extruded filamentary material intermediate the point of its maximum die swell area and its point of withdrawal from the conditioning zone was drawn down at a ratio of about 1500:1. The resulting yarn upon withdrawal from conditioning zone 26 exhibited a denier per filament of about 2.

For comparative purposes, Example II was repeated with the exception that the static air atmosphere of the conditioning zone 26 was provided at room temperature (i.e., about 25°C.) instead of 120°C. The extruded filamentary material intermediate the point of its maximum die swell area and its point of withdrawal from the conditioning zone was drawn down at a ratio of about 1500:1. The resulting yarn upon withdrawal from conditioning zone 26 exhibited a denier per filament of 2.

Summarized below are the average single filament properties of the resulting polyethylene terephthalate yarns achieved. See our commonly assigned U.S. Ser. No. 400,864, entitled "Improved Polyester Fiber" filed concurrently herewith, for a more detailed discussion of how the reported properties were determined.

| | With Invention (Conditioning Tube at 120°C.) | Without Invention (Conditioning Tube at 25°C.) |
|---|---|---|
| Denier Per Filament | 2 | 2 |
| Mean Yarn Tenacity (grams per denier) | 4 | 2.36 |
| Mean Yarn Elongation (percent) | 50 | 133 |
| Mean Yarn Initial Modulus (grams per denier) | 76 | 24.1 |
| Mean Yarn Shrinkage at 100°C. (percent) | 3.8 | 33.0 |
| Mean Yarn Shrinkage at 175°C. | 7.8 | 22.0 |

-continued

| | With Invention (Conditioning Tube at 120°C.) | Without Invention (Conditioning Tube at 25°C.) |
|---|---|---|
| (percent) | | |
| Mean Yarn Internal Tension at 100°C. (grams/denier) | 0.41 | 0.033 |
| Mean Yarn Internal Tension at 175°C. (grams/denier) | 0.35 | 0.011 |
| Maximum Yarn Internal Tension (grams/denier) | 0.42 | 0.052 |
| Shrinkage Modulus at 100°C. (grams/denier) | 10.8 | 0.10 |
| Shrinkage Modulus at 175°C. (grams/denier) | 4.49 | 0.050 |
| Modulus Ratio | 0.442 | 0.00417 |
| Birefringence | 0.1240 | 0.046 |
| Crystalline Orientation Function | 0.94 | * |
| Amorphous Orientation Function | 0.28 | 0.17 |

* = Not crystalline enough to yield useful diffraction

It can be seen from the preceding data of Examples I and II that the process of the present invention is capable of yielding a polyethylene terephthalate fiber of substantially increased tenacity and modulus in combination with a significantly reduced shrinkage. Conventional polyester fiber hot drawing procedures are rendered unnecessary when such a fiber is produced.

As indicated by the data present in our commonly assigned U.S. Ser. No. 400,864, entitled"Improved Polyester Fiber", filed concurrently herewith, at Comparative Examples 8 and 9, these results cannot be achieved if one should attempt to divide the presently claimed process by collection of the filamentary material after it leaves the solidification zone, and by subsequent passage of the same while under a comparable stress through the conditioning zone provided at a comparable temperature. Accordingly, the process of the present invention is capable of producing unexpected results which cannot be duplicated by the subsequent passage of a filamentary material or film resulting from a high stress spinning operation through an annealing zone where stress isolation exists between zones.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. An improved process for expeditously forming and structurally modifying a polyester filamentary material consisting essentially of:

a. extruding a molten fiber-forming polyester capable of undergoing crystallization through a shaped orifice to form a molten filamentary material, b. passing the resulting molten filamentary material in the direction of its length through a solidification zone provided with a gaseous atmosphere at a temperature below the glass transition temperature thereof wherein said molten filamentary material is uniformly quenched and is transformed to a solid filamentary material, c. passing said resulting filamentary material in the direction of its length through a conditioning zone provided with a gaseous atmosphere at a tempereature above the glass transition temperature thereof and below the melting temperature thereof for a residence time of about 0.0016 to 0.6 second, wherein substantial crystallization of said previously solidified filamentary material takes place, and d. withdrawing the resulting filamentary material from said conditioning zone at a rate of about 2500 to 6000 meters per minute while under a stress of about 0.1 to 1.0 gram per denier; said resulting filamentary material exhibiting no substantial tendency to undergo self-crimping upon the application of heat, exhibiting a mean tenacity of at least 3.25 grams per denier, a mean initial modulus of at least 55 grams per denier, and a mean elongation of 50 percent or less when present in a multifilament yarn at 25°C., and exhibiting a mean longitudinal yarn shrinkage of less than 5 percent when present in a multifilament yarn at 100°C.;

with said processing of said polyester filamentary material following said extrusion being conducted while exerting a constant tension thereon in the absence of stress isolation along the length of the same intermediate said shaped orifice and said point of withdrawal from said conditioning zone.

2. A process according to claim 1 wherein said fiber-forming polyester contains 85 to 100 mol percent polyethylene terephthalate and 0 to 15 mol percent of copolymerized ester units other than polyethylene terephthalate.

3. A process according to claim 1 wherein said melt-spinnable polyester is substantially all polyethylene terephthalate.

4. A process according to claim 1 wherein said gaseous atmosphere of said solidification zone is provided at a temperature of about 10° to 40°C.

5. A process according to claim 1 wherein said gaseous atmosphere of said solidification zone is air.

6. A process according to claim 1 wherein said gaseous atmosphere of said conditioning zone is air.

7. A process according to claim 1 wherein said filamentary material is present in said conditioning zone for a residence time of about 0.03 to 0.09 second.

8. A process according to claim 1 wherein said filamentary material is withdrawn from said conditioning zone at a rate of about 2500 to 3500 meters per minute.

9. A process according to claim 1 wherein said filamentary material is a flat yarn consisting of about 6 to 200 filaments.

10. A process according to claim 1 wherein said filamentary material when withdrawn from said conditioning zone exhibits a denier per filament of about 1 to 15.

11. An improved process for expeditiously forming and structurally modifying polyester filamentary material consisting essentially of:

a. extruding a molten fiber-forming polyester capable of undergoing crystallization containing at least 85 mol percent of polyethylene terephthalate through a spinneret to form a molten filamentary material, b. passing the resulting molten polyester filamentary material in the direction of its length through a solidification zone provided with a gaseous atmosphere at a temperature below 80°C. wherein said molten polyester filamentary material is uniformly quenched and is transformed to a solid filamentary material, c. passing said resulting filamentary material in the direction of its length through a conditioning zone provided with a gaseous atmosphere at a temperature of about 90° to 180°C. for a residence time of about 0.0016 to 0.6 second wherein substantial crystallization of said previously solidified filamentary material takes place, and withdrawing the resulting filamentary material from said conditioning zone at a rate of about 2500 to 6000 meters per minute while under a stress of about 0.1 to 1.0 gram per denier; said resulting filamentary material exhibiting no substantial tendency to undergo self-crimping upon the application of heat, exhibiting a mean tenacity of at least 3.75 grams per denier, a mean initial modulus of at least 75 grams per denier, and a mean elongation of 50 percent or less when present in a multifilament yarn at 25°C., and exhibiting a mean longitudinal yarn shrinkage of less than 5 percent when present in a multifilament yarn at 100°C.;

with said processing of said filamentary material following said extrusion being conducted while exerting a constant tension thereon in the absence of stress isolation along the length of the same intermediate said spinneret and said point of withdrawal from said conditioning zone.

12. A process according to claim 11 wherein said molten fiber-forming polyester is at a temperature of about 270° to 310°C. when extruded through said spinneret.

13. A process according to claim 11 wherein said fiber-forming polyester contains 85 to 100 mol percent polyethylene terephthalate structural units and 0 to 15 mol percent of copolymerized ester units other than polyethylene terephthalate.

14. A process according to claim 11 wherein said fiber-forming polyester is substantially all polyethylene terephthalate.

15. A process according to claim 11 wherein said gaseous atmosphere of said solidification zone is provided at a temperature of about 10° to 40°C.

16. A process according to claim 11 wherein said gaseous atmosphere of said solidification zone is air.

17. A process according to claim 11 wherein said gaseous atmosphere of said conditioning zone is provided at a temperature of about 110° to 120°C.

18. A process according to claim 11 wherein said gaseous atmosphere of said conditioning zone is air.

19. A process according to claim 11 wherein said filamentary material is present in said conditioning zone for a residence time of about 0.03 to 0.09 second.

20. A process according to claim 11 wherein said filamentary material is withdrawn from said conditioning zone at a rate of about 2500 to 3500 meters per minute.

21. A process according to claim 11 wherein said resulting filamentary material is a flat yarn consisting of about 6 to 200 filaments.

22. A process according to claim 11 wherein said filamentary material when withdrawn from said conditioning zone exhibits a denier per filament of about 1 to 15.

23. An improved process for expeditiously forming and structurally modifying polyethylene terephthalate filamentary material consisting essentially of:

a. extruding molten fiber-forming polyethylene terephthalate at a temperature of about 270° to 310°C. through a spinneret, b. passing the resulting molten polyethylene terephthalate filamentary material in the direction of its length through a solidification zone provided with a gaseous atmosphere at a temperature below 80°C. wherein said extruded polyethylene terephthalate filamentary material is uniformly quenched and is transformed to a solid filamentary material, c. passing the resulting filamentary material in the direction of its length through a conditioning zone provided with a gaseous atmosphere at a temperature of about 100° to 140°C. for a residence time of about 0.0016 to 0.6 second, and d. withdrawing the resulting filamentary material from said conditioning zone at a rate of about 2500 to 3500 meters per minute while under a stress of about 0.15 to 0.6 gram per denier; said resulting filamentary material exhibiting no substantial tendency to undergo self-crimping upon the application of heat, exhibiting a mean tenacity of at least 3.75 grams per denier, a mean initial modulus of at least 75 grams per denier, and a mean elongation of 50 percent or less when present in a multifilament yarn at 25°C., and exhibiting a mean longitudinal yarn shrinkage of less than 5 percent when present in a multifilament yarn at 100°C.;

with said processing of said filmentary material following said extrusion being conducted while exerting a constant tension thereon in the absence of stress isolation along the length of the same intermediate said spinneret and said point of withdrawal from said conditioning zone.

24. A process according to claim 23 wherein said molten fiber-forming polyethylene terephthalate is at a temperature of about 285° to 305°C. when extruded through said spinneret.

25. A process according to claim 23 wherein said gaseous atmosphere of said solidification zone is provided at a temperature of about 10° to 40°C.

26. A process according to claim 23 wherein said gaseous atmosphere of said solidification zone is air.

27. A process according to claim 23 wherein said gaseous atmosphere of said conditioning zone is provided at a temperature of about 110° to 120°C.

28. A process according to claim 23 wherein said gaseous atmosphere of said conditioning zone is air.

29. A process according to claim 23 wherein said filamentary material is present in said conditioning zone for a residence time of about 0.03 to 0.09 second.

30. A process according to claim 23 wherein said resulting filamentary material is a flat yarn consisting of about 6 to 200 filaments.

31. A process according to claim 23 wherein said filamentary material when withdrawn from said conditioning zone exhibits a denier per filament of about 1 to 15.

32. An improved process for expeditiously forming and structurally modifying a flat polyethylene terephthalate yarn which exhibits no substantial tendency to undergo self-crimping upon the application of heat consisting essentially of:

a. extruding molten fiber-forming polyethylene terephthalate at a temperature of about 300°C. through a spinneret containing about 6 to 200 extrusion holes having a diameter of about 10 to 60 mils, b. passing the resulting molten polyethylene terephthalate material in the direction of its length through a solidification zone provided with an air atmosphere at about 10° to 40°C. wherein said extruded polyethylene terephthalate material is uniformly quenched and is transformed to a solid multifilament yarn, c. passing the resulting yarn in the direction of its length through a conditioning zone provided with a gaseous atmosphere at about 110° to 120°C. for a residence time of about 0.03 to 0.09 second, and d. withdrawing the resulting yarn having a denier per filament of about 1 to 10 from said conditioning zone at a rate of about 2500 to 3500 meters per minute while under a stress of about 0.2 to 0.4 gram per denier; said resulting filamentary material exhibiting a mean tenacity of at least 3.75 grams per denier, a mean initial modulus of at least 75 grams per denier, and a mean elongation of 50 percent or less when present in a multifilament yarn at 25°C., and exhibiting a mean longitudinal yarn shrinkage of less than 5 percent when present in a multifilament yarn at 100°C.;

with said processing of said yarn following said extrusion being conducted while exerting a constant tension thereon in the absence of stress isolation along the length of the same intermediate said spinneret and said point of withdrawal from said conditioning zone.

* * * * *

UNITED STATES PATENT OFFICE

CERTIFICATE OF CORRECTION

Patent No. 3,946,100 Dated March 23, 1976

Inventor(s) Herbert L. Davis et al.

It is certified that error appears in the above-identified patent and that said Letters Patent are hereby corrected as shown below:

Correct the last name of the second joint-inventor to read "Jaffe".

Column 1, line 35, delete "of" and insert --or--.

Column 7, line 8, delete "means" and insert --mean--.

Column 9, line 10, delete "through" and insert --throughout--.

Column 11, line 15, delete "0.442" and insert --0.142--.

CERTIFICATE OF CORRECTION

Patent No. 3,946,100 Dated March 23, 1976

Inventor(s) Herbert L. Davis et al.

It is certified that error appears in the above-identified patent and that said Letters Patent are hereby corrected as shown below:

Claim 1, line 1, delete "expeditously" and insert --expeditiously--.

Claim 11, line 22, at the beginning of the line insert --d.--.

Signed and Sealed this

Twenty-third Day of May 1978

[SEAL]

Attest:

RUTH C. MASON
Attesting Officer

LUTRELLE F. PARKER
Acting Commissioner of Patents and Trademarks